United States Patent [19]

Victor et al.

[11] Patent Number: 4,838,913

[45] Date of Patent: Jun. 13, 1989

[54] DOUBLE COLUMN AIR SEPARATION PROCESS WITH HYBRID UPPER COLUMN

[75] Inventors: Richard A. Victor; Michael J. Lockett, both of Grand Island, N.Y.

[73] Assignee: Union Carbide Corporation, Danbury, Conn.

[21] Appl. No.: 154,301

[22] Filed: Feb. 10, 1988

[51] Int. Cl.[4] ..... F25J 3/04

[52] U.S. Cl. ..... 62/22; 62/24

[58] Field of Search ..... 62/22, 23, 24

[56] References Cited

U.S. PATENT DOCUMENTS

| | | | |
|---|---|---|---|
| 1,638,005 | 8/1927 | Le Rouge | 62/22 |
| 1,880,981 | 10/1932 | Pollitzer et al. | 62/31 |
| 2,545,462 | 3/1951 | Haynes | 62/175.5 |
| 2,547,177 | 4/1951 | Simpson | 62/175.5 |
| 2,700,282 | 1/1955 | Roberts | 62/175.5 |
| 2,728,205 | 12/1955 | Becker et al. | 62/122 |
| 2,762,208 | 9/1956 | Dennis | 62/122 |
| 3,620,032 | 11/1971 | Simonet | 62/22 |
| 3,729,943 | 5/1973 | Petit | 62/22 |
| 3,813,889 | 6/1974 | Allam et al. | 62/22 |
| 4,057,407 | 11/1977 | Bigi | 62/22 |
| 4,137,056 | 1/1979 | Golovko | 62/13 |
| 4,433,990 | 2/1984 | Olszewski | 62/22 |
| 4,533,375 | 8/1985 | Erickson | 62/22 |
| 4,715,874 | 12/1987 | Erickson | 62/22 |

*Primary Examiner*—Ronald C. Capossela

*Attorney, Agent, or Firm*—Stanley Ktorides

[57] ABSTRACT

A double rectification column air separation system with an associated argon column having a hybrid upper column containing both trays and packing in a defined construction wherein the upper column contains essentially exclusively packing below the argon column feed takeoff.

11 Claims, 1 Drawing Sheet

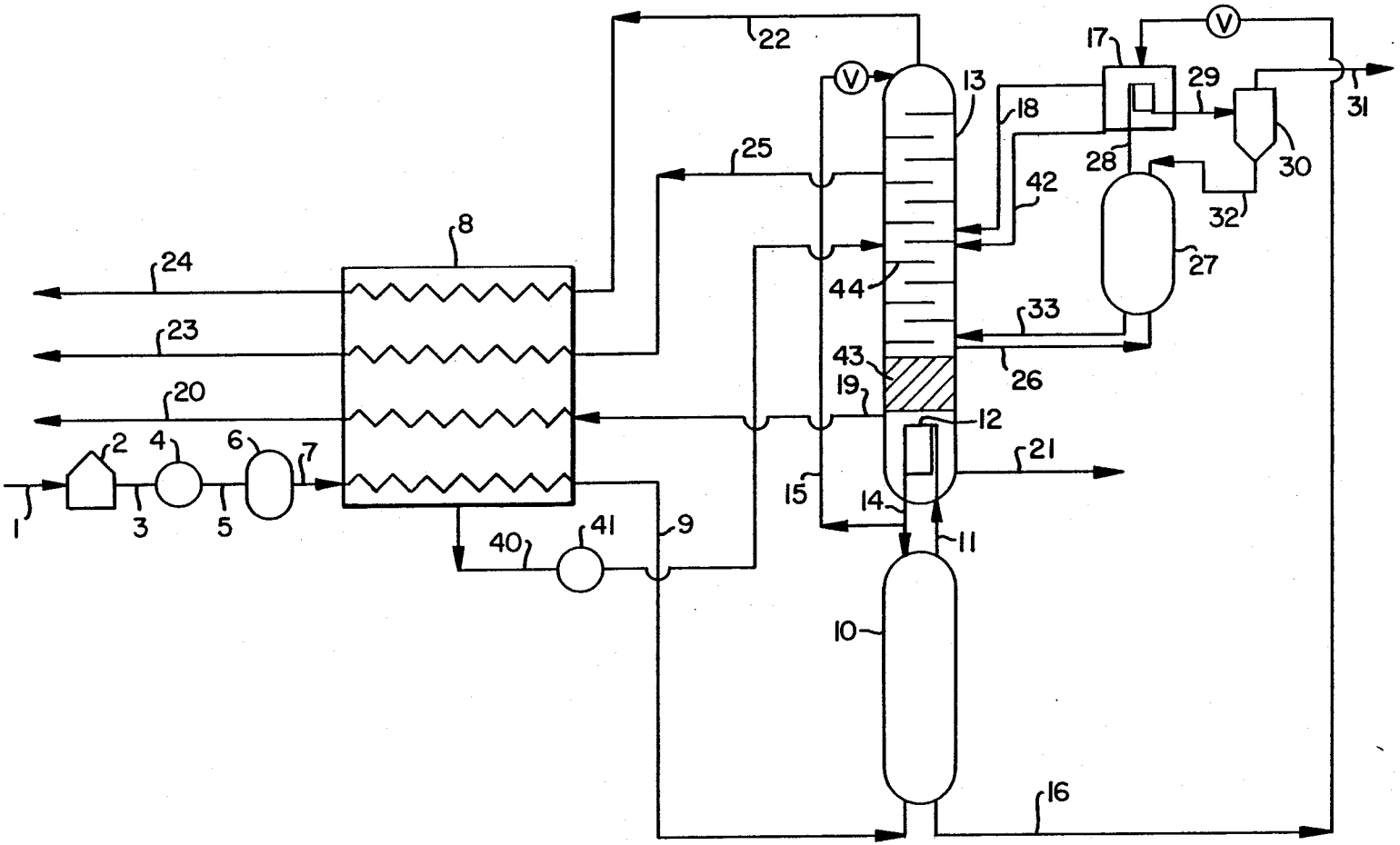
31
30
32
29
27
17
28
18
42
33
26
21
16
13
12
11
44
43
19
14
10
22
25
15
9
41
40
8
7
6
5
24
23
20
4
3
2
1

DOUBLE COLUMN AIR SEPARATION PROCESS WITH HYBRID UPPER COLUMN

TECHNICAL FIELD

This invention relates generally to air separation apparatus employing a double rectification column and a third column for argon recovery.

BACKGROUND ART

An often used system for the separation of a fluid mixture, such as the cryogenic separation of air, is a double rectification column apparatus. In such a system the feed air is separated in a first column operating at a higher pressure and in a second column operating at a lower pressure wherein a main condenser serves to reboil lower pressure column bottom liquid by heat exchange with higher pressure column top vapor. The separation is driven by elevated feed pressure which is generally attained by compressing the feed in a compressor prior to introduction into the columns. The power to operate this feed compressor is the major operating cost of the separation.

The separation is carried out by passing liquid and vapor in countercurrent contact through a column. The contact is effected on vapor-liquid contacting elements which may be trays or packing. If packing is used the packing may be either random packing or structured packing. However the contacting elements cause an unavoidable pressure drop within the columns. For example, the pressure drop in the lower pressure column of an air separation plant using trays is generally within the range of from 4 to 7 pounds per square inch (psi). This column pressure drop alone constitutes about 12 percent of the compression energy power requirement of the feed compressor. Packing is known to reduce the pressure drop in the columns by a considerable amount. However, random packing generally does not have sufficient reliability for demanding separations, such as the cryogenic distillation of air, and structured packing has a very high cost.

The use of packing also causes operating problems when the air separation plant comprises a third column for the recovery of argon. In this situation a stream having a relatively high argon concentration is taken from an intermediate point of the lower pressure column and passed into the lower portion of the argon column and up the column while becoming progressively richer in argon. A crude argon product is recovered at the top of the argon column. The fluid flows are due to a pressure difference between the argon column feed stream and crude argon product stream. This pressure difference is generally about 4 psi.

Vapor product is taken from the top of the lower pressure column at a pressure slightly above atmospheric, i.e., just enough to enable the product to pass out of the plant without need for pumping. Any higher vapor product pressure would cause a separation efficiency reduction within the lower pressure column. A typical such pressure is 16.5 pounds per square inch absolute (psia). If packing is employed within the lower pressure column, the resulting low pressure drop causes the pressure at the argon column feed point to be only slightly higher than atmospheric, such as about 17 psia rather than about 20 psia when trays are used. In order to attain the requisite argon column flow with trays in the argon column, the crude argon product must be taken at a pressure about 4 psi less than the 17 psia of the argon column feed, i.e. at about 13 psia. Since this is less than atmospheric pressure, there arises the undesirable potential for air leaks into the crude argon product. This undesirable situation may be alleviated by employing packing rather than trays within the argon column but this gives rise to higher cost, if structured packing is used, or compromised reliability, if random packing is used.

It is desirable therefore to have a double column air rectification system having reduced feed compression requirements.

Accordingly it is an object of this invention to provide a double column air rectification apparatus enabling reduced feed compression requirements.

It is another object of this invention to provide a double column air rectification apparatus enabling reduced feed compression requirements without need for substantially increased cost or decreased reliability.

It is a further object of this invention to provide a double column air rectification apparatus with an argon column, enabling reduced feed compression requirements, without causing subatmospheric crude argon recovery, substantially increased argon column costs or substantially decreased argon column reliability.

It is a still further object of this invention to provide a double column air separation process having reduced feed compression requirements without need for substantially increased cost or decreased reliability.

It is yet another object of this invention to provide a double column air separation process with crude argon recovery at superatmospheric pressure without need for substantially increased cost or decreased reliability.

SUMMARY OF THE INVENTION

The above and other objects which will become apparent to one skilled in the art upon a reading of this disclosure are attained by the present invention, one aspect of which is:

Apparatus comprising a first column containing vapor-liquid contacting elements, a second column containing vapor liquid contacting elements and a main condenser, means to pass fluid from the first column to the main condenser and from the main condenser to the first column, a third column containing vapor liquid contacting elements, and means to pass fluid from an intermediate point of the second column to the third column, characterized by the vapor-liquid contacting elements in the section of the second column below said intermediate point being essentially exclusively packing and the vapor liquid contacting elements in the remainder of the second column comprising trays.

Another aspect of the present invention comprises:

Air separation process comprising compressing feed air, separating the feed air into nitrogen-rich and oxygen rich components by countercurrent vapor-liquid contact in a double column air separation plant having lower pressure and higher pressure columns, removing nitrogen-rich component from the upper portion of the lower pressure column at a pressure not more than 3 psi greater than atmospheric, passing argon-containing fluid from an intermediate point of the lower pressure column into an argon column for separation into argon rich and oxygen-rich portions, and carrying out the countercurrent vapor liquid contact in the lower pressure column on vapor-liquid contacting elements which are essentially exclusively packing in the section of the lower pressure column below said intermediate point and on vapor-liquid contacting elements which comprise trays in the remainder of the lower pressure column.

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column if filled. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith, et al., page 13-3 *The Continuous Distillation Process.* The term, double column is used herein to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

As used herein, the term "argon column" means a column having a feed thereto taken from the lower pressure column of double column and wherein upflowing vapor becomes progressively enriched in argon by countercurrent flow against descending liquid.

The term "indirect heat exchange", as used herein means the bringing of two fluid streams into heat exchange relation without any physical contact or intermixing of the fluids with each other.

As used herein, the term "vapor liquid contacting elements" means any devices used as column internals to allow mass transfer at the liquid vapor interface during countercurrent flow of the two phases.

As used herein, the term "tray" means a substantially flat plate with openings and liquid inlet and outlet so that liquid can flow across the tray as vapor rises through the openings to allow mass transfer between the two phases.

As used herein, the term "packing" means any solid or hollow body of predetermined configuration, size, and shape used as column internals to provide surface area for the liquid to allow mass transfer at the liquid-vapor interface during countercurrent flow of the two phases.

As used herein, the term "random packing" means packing wherein individual members do not have any particular orientation relative to each other or to the column axis.

As used herein, the term "structured packing" means packing wherein individual members have specific orientation relative to each other and to the column axis.

BRIEF DESCRIPTION OF THE DRAWING

The sole FIGURE is a simplified schematic flow diagram, partly in cross-section, of one preferred embodiment of the apparatus and process of this invention.

DETAILED DESCRIPTION

The process and apparatus of this invention will be described in detail with reference to the FIGURE which illustrates one preferred system for the separation of air.

Referring now to the FIGURE, feed air 1 is cleaned of dust and other particulate matter by passage through filter 2. Filtered feed air 3 is compressed by passage through compressor 4 to a pressure generally within the range of from 70 to 170 psia. Compressed feed air 5 is then cleaned of high boiling impurities such as water, carbon dioxide and hydrocarbons, by passage through purifier 6. Cleaned, compressed feed air 7 is cooled to near liquefaction temperature by indirect heat exchange in heat exchanger 8 with product and waste streams from the columns. Cleaned, compressed and cooled feed air 9 is then introduced into first column 10 which is the higher pressure column of a double rectification column plant. Column 10 generally is operating at a pressure within the range of from 50 to 150 psia. A minor fraction 40 of the feed air is withdrawn from the middle of heat exchanger 8, expanded in turbine 41 and introduced into lower pressure column 13 at a point below the nitrogen withdrawal points but above the argon column feed withdrawal point Within column 10 the feed air is separated by rectification into nitrogen-rich vapor and oxygen enriched liquid. Nitrogen rich vapor 11 is passed through conduit means from column 10 to main condenser 12, which is preferably within second column 13, which is the lower pressure column of the double column rectification plant. Main condenser 12 may also be physically located outside the walls of column 13. Within main condenser 12 nitrogen rich vapor 11 is condensed by indirect heat exchange with reboiling column 13 bottom liquid. Resulting nitrogen rich liquid 14 is passed through conduit means to column 10 as reflux. A portion 15 of the resulting nitrogen-rich liquid, generally within the range of from 20 to 50 percent, is passed into column 13 at or near the top of the column.

Oxygen enriched liquid 16 is removed from first column 10 and passed into argon column top condenser 17 wherein it is partially vaporized by indirect heat exchange with argon column top vapor. Resulting vapor and liquid are passed into column 13 as streams 18 and 42 respectively at points below the nitrogen withdrawal points but above the argon column feed withdrawal point.

Second column 13 operates at a pressure less than that of first column 10 and generally within the range of from 12 to 30 psia. Within second column 13 the fluids introduced into the column are separated by rectification into nitrogen-rich and oxygen rich components which are recovered respectively as nitrogen and oxygen products. Oxygen product may be recovered as gas and/or liquid having a purity generally exceeding about 99 percent. Gaseous oxygen product is removed from second column 13 at a point above main condenser 12, passed as stream 19 through heat exchanger 8, and recovered as stream 20. Liquid oxygen product is removed from second column 13 at or below main condenser 12 and recovered as stream 21. Nitrogen product, having a purity generally exceeding about 99.9 percent, is removed from the top of second column 13 at a pressure generally within about 3 psi of atmospheric pressure as stream 22, passed through heat exchanger 8 and recovered as stream 24. The pressure of stream 22 as it is removed from second column 13 is preferably as low as possible but sufficiently higher than atmospheric pressure so as to ensure passage of nitrogen product out of the plant without need for auxiliary pumping. Waste nitrogen stream 25, necessary for proper operation of the separation system, is also removed from second column 13, passed through heat exchanger 8 and vented as stream 23. Stream 25 is taken from second column 13 at a point below the point where nitrogen stream 15 is introduced into the column As mentioned previously, the air separation system of this invention further comprises recovery of crude argon. Referring back to the FIGURE, a vapor stream 26 is withdrawn from an intermediate point of second column 13 where the argon concentration is at or close to a maximum, generally about 10 to 12 percent. If second column 13 were a trayed column, stream 26 would be at a pressure generally about 3 psi greater than that of the pressure of steam 22. Stream 26 is passed into and up third, or argon, column 27, operating at a pressure within the range of from 12 to 30 psia, wherein it becomes progressively enriched in argon by countercurrent flow against descending liquid. Argon enriched vapor 28 is passed from argon column 27 to top condenser 17 wherein it is partially condensed by indirect heat exchange with partially vaporizing oxygen-enriched liquid 16. Resulting partially condensed argon-enriched fluid 29 is passed to separator 30. Argon rich vapor 31 is recovered from separator 30 as crude argon product having an argon concentration generally exceeding 96 percent while liquid 32 is passed from separator 30 into argon column 27 as descending liquid. Liquid accumulating at the bottom of argon column 27, having an oxygen concentration exceeding that of stream 26, is passed as stream 33 into second column 13. The flow of vapor through argon column 27 is effected by the pressure difference, generally about 4 psi, between the pressure of stream 26 and the pressure of stream 28. In a trayed column, stream 26 would typically be at a pressure about 5 psi greater than atmospheric. Thus, stream 28 would be at a pressure of about 1 psi greater than atmospheric and crude argon product stream 31 would be recovered at only slightly above atmospheric.

As discussed previously a major operating cost of a double column rectification system is the power cost for the feed compression. A significant amount of this power requirement is due to system pressure drops. The apparatus and process of this invention employs a defined arrangement of vapor-liquid contacting elements within the lower pressure column of the double column system. The defined novel arrangement enables the simultaneous attainment of markedly reduced compression energy requirements without encountering operating difficulties or substantially increased capital costs.

Referring back to the FIGURE, the vapor-liquid contacting elements within second column 13 are essentially exclusively packing 43 in the section of the column below the point from where stream 26 is taken while the vapor-liquid contacting elements in the remainder of the column comprise trays 44. Generally at least 25 percent of the height of the second column within which vapor-liquid contact is carried out comprises packing. Preferably the lower pressure column contains exclusively packing vapor-liquid contacting elements below the point from where stream 26 is taken and exclusively trays in the remainder of the column. The defined packing is situated in column 13 from the point where stream 26 is removed down to the point where stream 19 is removed.

The packing used in conjunction with the present invention may be any suitable random or structured packing, although structured packing is preferred for demanding separations such as the separation of air. Among random packing one can name ring or saddle like elements whereas structured packing can include corrugated sheet with openings and surface textures or screen material.

Any suitable commercially available trays may be used with the present invention. Among such trays one can name bubble cap trays and sieve trays.

The invention attains its very advantageous, and normally mutually exclusive, benefits simultaneously, by taking advantage of certain physical chemistry effects at the area of the main condenser wherein substantially pure nitrogen and substantially pure oxygen are in heat exchange relation. The change in vapor pressure with change in temperature is different for almost pure oxygen and almost pure nitrogen. The change in vapor pressure of the nitrogen is approximately three times that of the oxygen for the same small change in temperature. A small reduction in the pressure at the bottom of the lower pressure column will result in a small reduction in the saturation temperature of the boiling oxygen. For a constant temperature difference across the main condenser, this translates into an equal reduction in the saturation temperature of the condensing nitrogen stream at the top of the higher pressure column. However, because of the nature of the vapor pressure temperature relationship, this small temperature reduction results in a reduction in pressure of the condensing nitrogen at the top of the higher pressure column which is about three times greater than the original reduction in pressure at the base of the lower pressure column. Accordingly, due to this multiplier effect, the invention enables a marked decrease in the overall feed compression energy requirements while maintaining capital costs much below what would otherwise be required if the entire column contained packing. The oxygen rich bottom liquid of the lower pressure column is boiled at a pressure not more than about 4 psi greater than the pressure at the top of the lower pressure column and of stream 22. Furthermore, the pressure at the intermediate point from where the argon column feed stream is taken is sufficiently above atmospheric to ensure the recovery of crude argon product at superatmospheric pressure thus avoiding the potential for air contamination or the need for compression of the crude argon product. The pressure at this intermediate point is not more than 3.5 psi greater than the pressure at the top of the lower pressure column and of stream 22.

As mentioned previously, the vapor-liquid contacting elements within the lower pressure column are essentially exclusively packing in the lower section. The vapor-liquid contacting elements in the remainder of the lower pressure column comprise trays; preferably they are essentially exclusively trays, but they may comprise a combination of trays and packing. In particular, it may be advantageous to also utilize packing in the top section of the lower pressure column above the waste nitrogen withdrawal point, since that column section has relatively little separation volume. Thus, the added energy savings associated with the use of packing can be gained at relatively low capital cost. The vapor liquid contacting elements within the higher pressure column and the argon column may be essentially exclusively trays, essentially exclusively packing or any combination of trays and packing. However, depending on the pressure of the feed stream to the argon column, the argon column should contain sufficient packing to ensure superatmospheric conditions at the top of the argon column.

By enabling the attainment of a very large reduction in compression energy requirements with only a small amount of packing, the invention enables the operation of much of the double column plant and argon column with trays thus enabling a significant reduction in capital costs while also markedly reducing operating costs. This is especially the case when an existing trayed plant is retrofitted since the investment in trays has already been made. In this situation only a small part of the plant need be changed to packing yet very significant power cost reductions are attained.

The following examples are computer simulations of the invention. They are presented for illustrative purposes and are not intended to be limiting.

EXAMPLE 1

A double column rectification plant similar to that shown schematically in the FIGURE is operated for the separation of feed air. The lower pressure column has structured packing below the argon column feed stream takeoff and sieve trays in the remainder. The vapor-liquid contacting elements within the argon column are all trays. Nitrogen vapor is taken from the top of the lower pressure column at a pressure of 16.5 psia. The pressure at the bottom of the column is 20.3 psia thus enabling the requisite heat exchange in the main condenser to occur at a nitrogen pressure of 76.5 psia. In order to carry out this operation, the feed air is compressed to only 85 psia which is a 5 percent reduction over that which would be required by an all trayed plant, but with very little equipment modification required. Moreover the pressure at the argon column feed takeoff is 19.9 psia resulting in a pressure at the top of the argon column of 16.0 psia, thus ensuring superatmospheric crude argon recovery.

EXAMPLE 2

The rectification plant of Example 1 is modified to replace trays with packing in the portion of the lower pressure column above the waste nitrogen takeoff point, and the air separation process is repeated. Nitrogen vapor is taken from the top of the lower pressure column at a pressure of 16.5 psia. The pressure at the bottom of the column is 19.7 psia thus enabling the requisite heat exchange in the main condenser to occur at a nitrogen pressure of 74.5 psia. In order to carry out this operation, the feed air is compressed to only 83 psia, which is a 6 percent reduction over that which would be required by an all trayed plant. The pressure at the argon column feed takeoff is 19.3 psia resulting in a pressure at the top of the argon column of 15.3 psia, thus ensuring superatmospheric crude argon recovery.

Now by the use of the apparatus and process of this invention one can attain a marked decrease in compression energy requirements for a double column air separation plant while largely avoiding the increased costs associated with structured packing, and also ensuring proper operation of an argon column. While the invention has been described in detail with reference to certain embodiments, it is recognized by those skilled in the art that there are other embodiments of the invention within the spirit and scope of the claims.

We claim:

1. Air separation process comprising compressing feed air, separating the feed air into nitrogen-rich and oxygen-rich components by countercurrent vapor-liquid contact in a double column air separation plant having lower pressure and higher pressure columns, removing nitrogen-rich component from the upper portion of the lower pressure column at a pressure not more than 3 psi greater than atmospheric, passing argon containing fluid from an intermediate point of the lower pressure column onto an argon column for separation into argon-rich and oxygen-rich portions, and carrying out the countercurrent vapor-liquid contact in the lower pressure column on vapor-liquid contacting elements consisting essentially of packaging in the section of the lower pressure column below said intermediate point and on vapor-liquid contacting elements which comprise trays in the remainder of the lower pressure column.

2. The process of claim 1 wherein the countercurrent vapor-liquid contact in the remainder of the lower pressure column is carried out on vapor liquid contacting elements consisting essentially of trays.

3. The process of claim 1 wherein the countercurrent vapor liquid contact in the remainder of the lower pressure column is carried out on vapor liquid contacting elements which comprise packing and trays.

4. The process of claim 1 wherein the air is compressed to a pressure within the range of from 70 to 170 psia.

5. The process of claim 1 wherein the higher pressure column is operating at a pressure within the range of from 50 to 150 psia, the lower pressure column is operating at a pressure less than that of the higher pressure and within the range of from 12 to 30 psia, and vapor from the higher pressure column is condensed by indirect heat exchange with vaporizing liquid from the lower pressure column at a pressure not more than 4 psi greater than that of the pressure of the nitrogen rich component removed from the upper portion of the lower pressure column.

6. The process of claim 1 wherein the argon-rich portion is recovered as crude argon product at a superatmospheric pressure.

7. The process of claim 1 wherein the pressure at said intermediate point is not more than 3.5 psi greater than that of the pressure of the nitrogen rich component removed from the upper portion of the lower pressure column.

8. The process of claim 1 further comprising removal of waste nitrogen from the lower pressure column at a point below the point from where nitrogen rich component is removed, and carrying out countercurrent vapor liquid contact in the section of the lower pressure column above said waste nitrogen removal point on vapor liquid contacting elements which comprise packing.

9. The process of claim 1 further comprising recovering oxygen-rich component from the lower pressure column as oxygen product having a purity exceeding about 99 percent.

10. The process of claim 1 wherein the argon rich portion is recovered as crude argon product having a purity exceeding 96 percent.

11. The process of claim 1 wherein the argon containing fluid from the intermediate point of the lower pressure column has an argon concentration within the range of from 10 to 12 percent.

* * * * *

UNITED STATES PATENT AND TRADEMARK OFFICE

CERTIFICATE OF CORRECTION

PATENT NO. : 4,838,913

DATED : June 13, 1989

INVENTOR(S) : R.A. Victor et al

It is certified that error appears in the above-identified patent and that said Letters Patent is hereby corrected as shown below:

In column 5, line 11 delete "steam" and insert therefor --stream--.

In column 8, line 11, delete "packaging" and insert therefor --packing--.

Signed and Sealed this

Nineteenth Day of March, 1991

*Attest:*

HARRY F. MANBECK, JR.

*Attesting Officer*

*Commissioner of Patents and Trademarks*